United States Patent [19]

Shaw

[11] Patent Number: 4,951,718

[45] Date of Patent: Aug. 28, 1990

[54] REPAIR OF BROKEN WEFT THREADS USING PLURAL YARN SUPPLY PACKAGES

[75] Inventor: Henry Shaw, Vleteren, Belgium

[73] Assignee: Picanol N.V., Belgium

[21] Appl. No.: 239,794

[22] Filed: Sep. 2, 1988

[30] Foreign Application Priority Data

Sep. 2, 1987 [BE] Belgium ..... 8700981

[51] Int. Cl.[5] ..... D03D 47/36

[52] U.S. Cl. ..... 139/450; 139/452; 139/453

[58] Field of Search ..... 139/116, 370.2, 435, 139/429, 256 A, 450, 436, 452, 453

[56] References Cited

U.S. PATENT DOCUMENTS

| | | | |
|---|---|---|---|
| 3,533,451 | 10/1970 | Stingl | 139/450 |
| 4,054,159 | 10/1977 | Juillard | 139/450 |
| 4,423,586 | 1/1984 | Matsui | 57/22 |
| 4,450,876 | 5/1984 | van Mullekom | 139/435 |
| 4,620,570 | 11/1986 | Suzuki | 139/435 |
| 4,635,686 | 1/1987 | Terasaki | 139/116 |
| 4,658,866 | 4/1987 | Takegawa | 139/450 |
| 4,756,341 | 7/1988 | Takehana | 139/450 X |
| 4,832,091 | 5/1989 | Shaw | 139/452 X |

FOREIGN PATENT DOCUMENTS

| | | |
|---|---|---|
| 1000368 | 3/1984 | Belgium . |
| 901969 | 9/1985 | Belgium . |
| 905312 | 2/1987 | Belgium . |
| 0171057 | 2/1986 | European Pat. Off. . |
| 2927571 | 1/1980 | Fed. Rep. of Germany . |
| 3153083 | 10/1985 | Fed. Rep. of Germany . |
| 2851189 | 6/1987 | Fed. Rep. of Germany . |
| 479735 | 11/1969 | Switzerland . |
| 658446 | 11/1986 | Switzerland . |
| 660873 | 5/1987 | Switzerland . |

*Primary Examiner*—Andrew M. Falik

*Attorney, Agent, or Firm*—Bacon & Thomas

[57] ABSTRACT

A method for repairing a weft thread on a weaving machine, in particular for repairing thread breaks between a yarn supply package and an accumulator, includes the step of providing at least two yarn supply packages, a second package automatically replacing the one in use when the one in use becomes empty. Additional steps include using a thread clip to hold a thread end of the second supply package, monitoring the weft thread for breaks between the supply package in use and the accumulator, and when a thread break is detected, gripping the thread end of the second supply package and joining it to the broken weft section which is connected to the accumulator. An apparatus is provided which includes means for carrying out each of the above-described steps.

16 Claims, 6 Drawing Sheets

Fig. 13
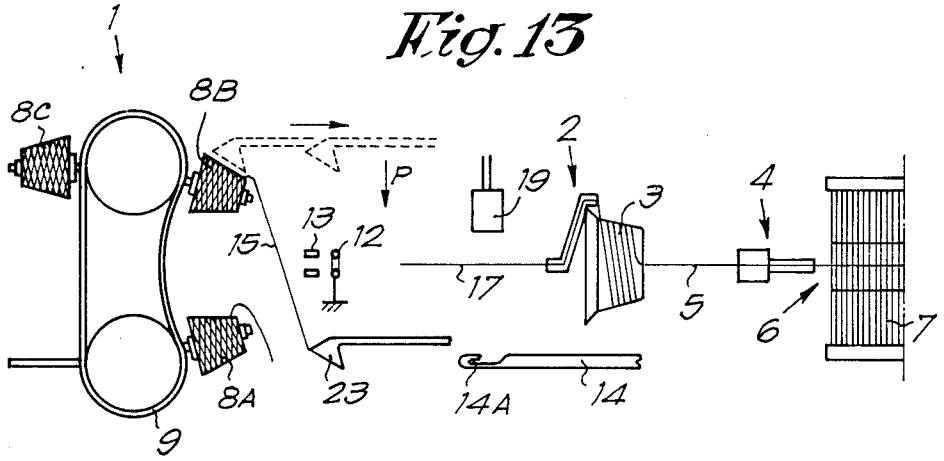
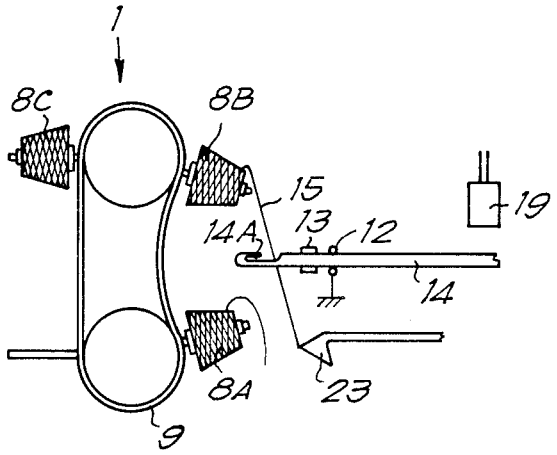
Fig. 14

REPAIR OF BROKEN WEFT THREADS USING PLURAL YARN SUPPLY PACKAGES

FIELD OF THE INVENTION

This invention concerns a method for repairing a broken weft thread on weaving machines, in particular for repairing thread breaks which occur between the yarn supply package in use and the device, itself common technology, for forming a particular thread accumulation necessary for inserting a weft thread into the shed.

The method is particularly applicable to a weaving loom which uses a rotating package frame preferably of the type where the supply packages are presented one after the other to the insertion mechanism by a conveyor belt.

BACKGROUND OF THE INVENTION

In conventional weaving machines, a disadvantage exists in that thread breaks which occur between the yarn supply and the yarn accumulator must be repaired manually, and in that the accumulator must then be rethreaded manually. Furthermore, manual rethreading has generally been required when the yarn supply, for example a yarn package, becomes empty.

In connection with the latter disadvantage, devices exist which ensure a continuous supply of thread by tying together two yarn packages and automatically switching from one to the other, as disclosed in U.S. Pat. No. 4,450,876. However, this type of device still suffers from the disadvantage that repair and rethreading after a thread break must be done manually.

SUMMARY OF THE INVENTION

The method according to the invention includes the steps of continually providing yarn supply packages; using a thread clip to hold the thread end of at least the supply package following the yarn supply package in use; monitoring the weft thread for breaks between the supply package in use and the device for forming the above-mentioned thread accumulation; and when a break is detected, gripping the thread end of the following supply package which is not in use and tying it to the weft section of broken thread which is still connected to the thread accumulating device.

BRIEF DESCRIPTION OF THE DRAWINGS

In order to explain the characteristics of the invention, the following preferred embodiments are described, without being limitative in any way, with reference to the accompanying drawings, where:

FIGS. 5 to 9, 10 to 12, 13 to 14, and 16 respectively show four variants of the invention.

DETAILED DESCRIPTION OF THE PREFERRED EMBODIMENTS

Figure 1:
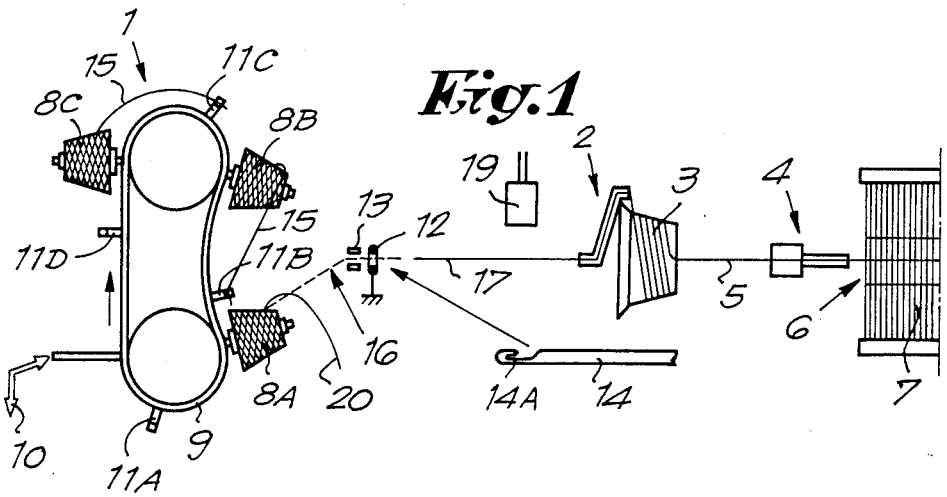
FIGS. 1 to 3 are schematic diagrams illustrating the method according to the invention.

FIG. 1 shows a weft insertion mechanism which, as is known, includes a package frame 1, a device 2 on which a particular thread accumulation 3 can be formed, and a weft insertion device 4 for inserting the weft thread 5 into the shed 6 on the weaving machine, where this thread 5, as is known, is beaten up between the warp threads by a reed 7.

The package frame 1 is of the type where in addition to the supply package in use 8A, at least one second supply package 8B is held in readiness to be used as soon as the previous package is empty or is no longer connected to the device 2 as the result of a thread break. In this embodiment, this is achieved by using a package frame 1 consisting of a conveyor belt 9, such that as shown schematically by the arrow 10 the empty supply packages can be evacuated automatically, while a full supply package is presented automatically. The device 2 used to form a weft accumulation 3 can consist of e.g. a prewinder which itself is common technology.

Clearly, on an airjet weaving machine the insertion device 4 will consist of a main injector or similar, while on a gripper machine it will be formed by grippers.

Also in FIG. 1, use is made of: a number of thread clips 11A to 11D which in this case are mounted on the conveyor belt 9; a thread eye 12 through which the weft thread 5 is led from the package frame 1 to the device 2 for forming 8 a thread accumulation 3; a detection device 13; and a threading device 14 or suchlike. The detection device 13 monitors the thread 5 for breaks, either by detecting the absence of the thread or by detecting that the thread is not moving.

The method according to the present invention consists of gripping the thread end 15 of at least the supply package 8B following the supply package in use 8A, by means of a thread clip 11B. In the embodiment shown in FIG. 1, the thread end 15 of each supply package 8 is brought into the corresponding thread clip 11 during installation of the package on conveyor belt 9.

Here it should be noted that either mechanical or pneumatic thread clips (thread catchers) 11A–11D can be used. Pneumatic thread catchers, consisting of e.g. suction nozzles, offer the advantage that the thread is always held kept stretched between the thread catcher and the supply package, even if the distance between the thread catcher and the supply package changes as a result of rotation of the conveyor belt 9 of the package frame 1.

Figure 2:
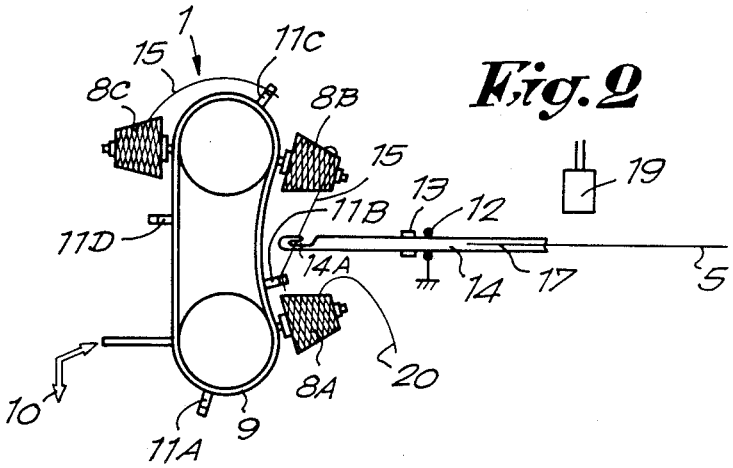
Figure 3:
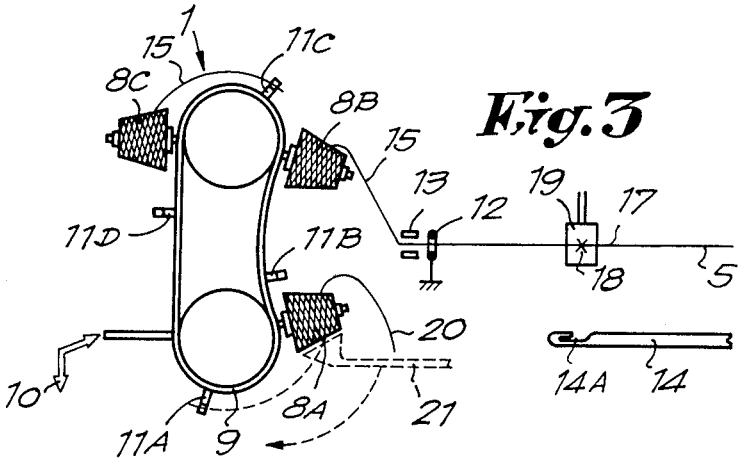

If a thread break 16 occurs, as shown in FIG. 1, this is detected by the detector 13. As a result of this detection, the threading device 14 is actuated e.g., in the manner shown in Belgian Pat. No. 1,000,368, and U.S. Pat. No. 4,054,159 and 4,756,341, such that said threading device moves through the thread eye 12 and grips the thread end 15 of the next supply package 8B, as shown in FIG. 2. The clip 14A of the threading device 14 can be either mechanical or pneumatic, e.g. in the form of a suction nozzle. The threading device 14 is then drawn back, thus threading the detector 13 and the thread eye 12, after which the thread end 15 is joined to the weft section 17, preferably by means of a welded splice 18, as shown in FIG. 3. The join can be made by devices which themselves are common technology, for example a tying-in device or a splicer, represented in the figures by reference numeral 19. A known knotting device is shown, for example, in U.S. Pat. No. 4,423,586.

The free end 20 formed on the supply package 8A previously in use can be brought back into the thread clip 11A in various ways.

As shown in FIG. 3 this is done by means of a suction nozzle 21 which scans the outer surface of the corresponding supply package 8A, catches the thread end 20 and then brings it into the thread clip 11A.

Figure 15:
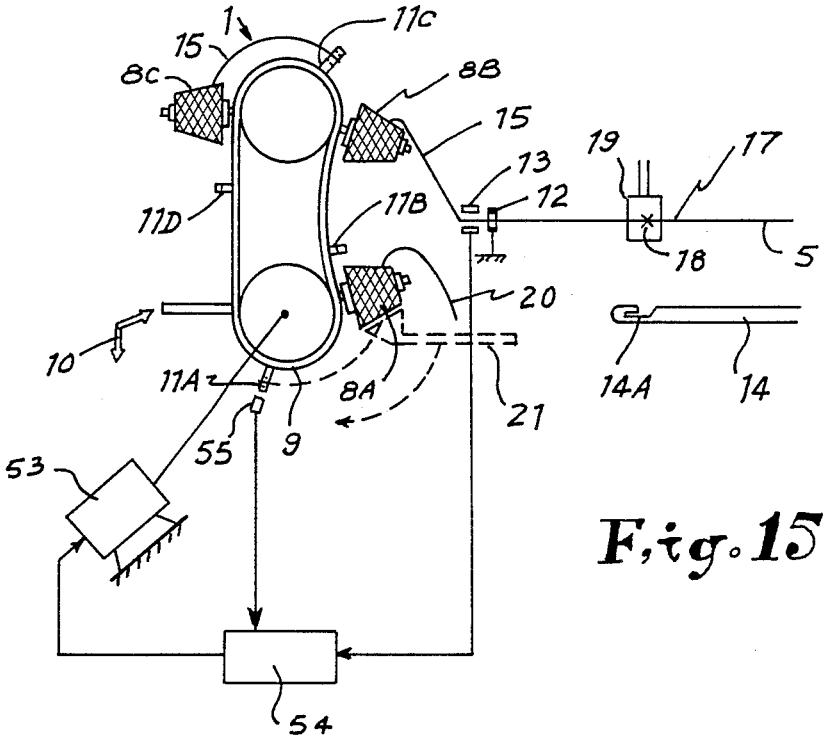
FIG. 15 is a schematic diagram showing control means for carrying out the method of FIGS. 1 to 3.

As shown in FIG. 15, the conveyor belt 9 can be driven by means of a motor 53. This motor is controlled by means of a control unit 54 which in turn is coupled to detector 13. Upon detecting a thread break, motor 53 is switched on to move the conveyor over a distance which is equal to the distance between the two packages. The displacement can be controlled by means of a proximity switch 55 or the like. An exact displacement can also be obtained by using a stepper motor.

Figure 4:
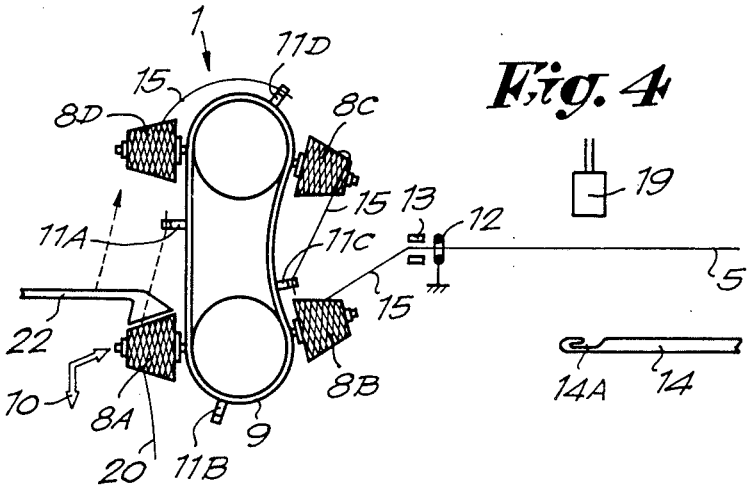
FIG. 4 shows a variant of the step shown in FIG. 3.

As shown in FIG. 4, the supply package 8A is first brought back into the position where new supply packages are normally mounted on the conveyor belt 9, in order for the thread end 20 to be led into the thread clip 11A by the suction nozzle 22. Clearly, in this case when a new supply package is mounted the suction nozzle 22 also has the function of finding its thread end 15 and leading said thread end into the corresponding thread clip.

Figure 5:
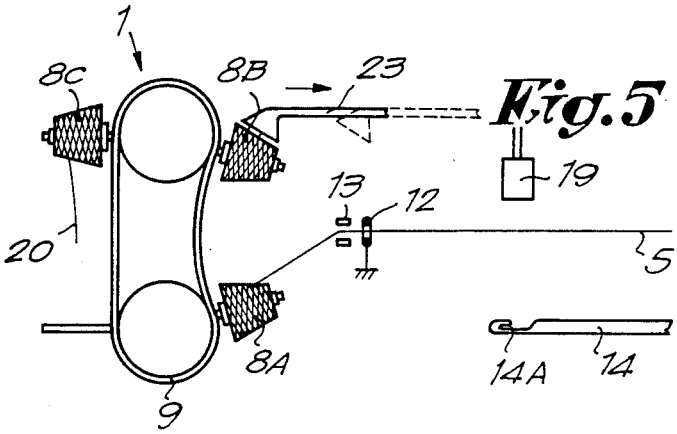
Figure 6:
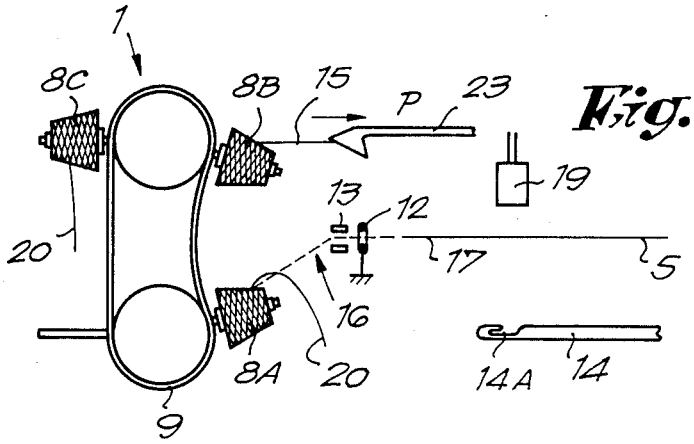
Figure 7:
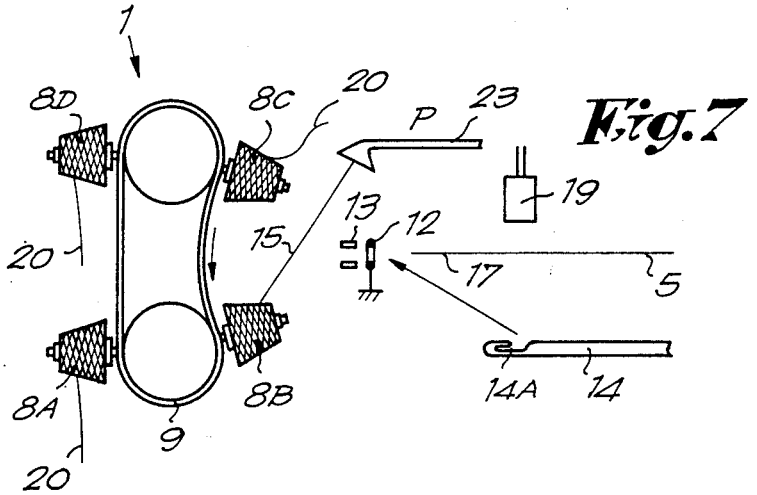
Figure 8:
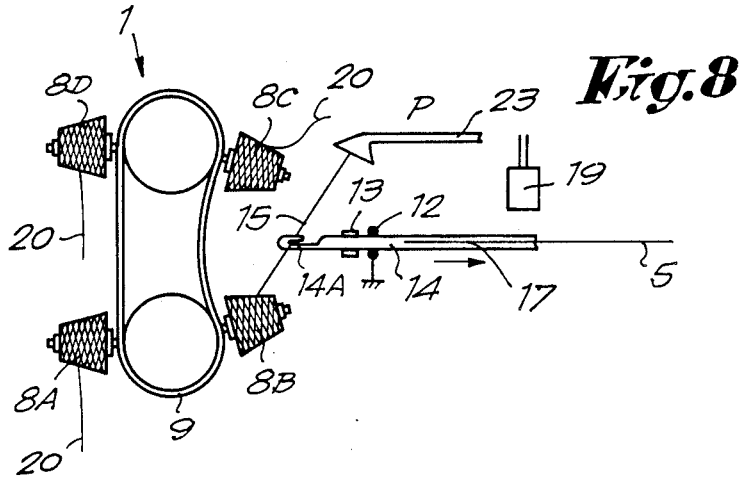
Figure 9:
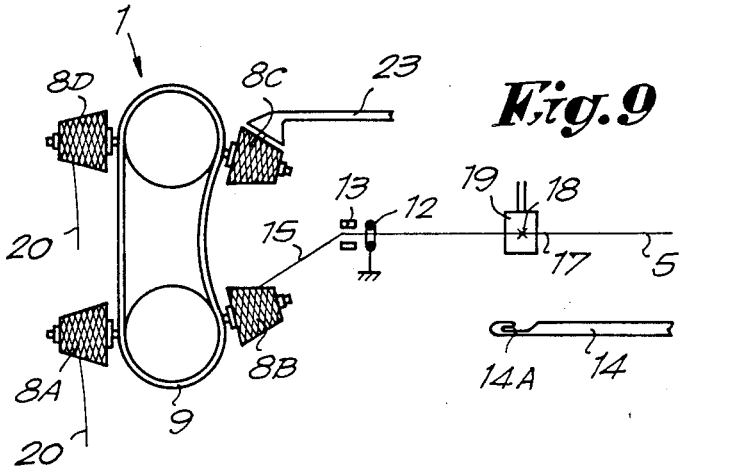

In the embodiment shown in FIGS. 5 to 9, instead of the above-mentioned thread clips 11 a single pneumatic thread catcher or suction nozzle 23 is used. By means of this suction nozzle 23 the thread end 15 of the next new supply package 8B is found and caught, whereupon said suction nozzle 23 is brought to a particular point P, as shown in FIG. 6. When the detector 13 detects a thread break 16, the package frame 1 is actuated such that said package 8B is brought into the same position as the package previously in use 8A, so that, as shown in FIG. 7, the thread end 15 is situated in front of the thread eye 12 and the detector 13. As shown in FIG. 8, it is then simple for the thread end 15 to be drawn through the detector 13 and the thread eye 12 by means of the threading device 14 and then connected to the the weft section 17, as shown in FIG. 9.

Figure 10:
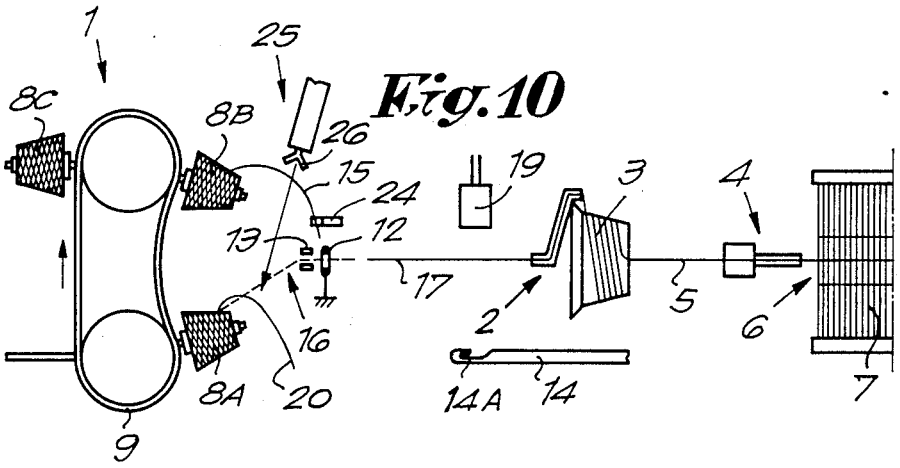
Figure 11:
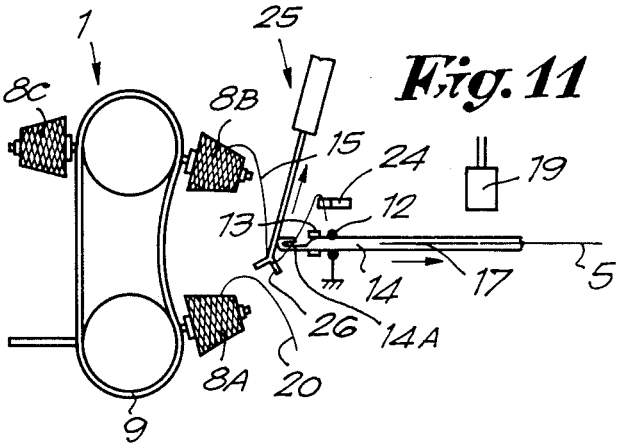
Figure 12:
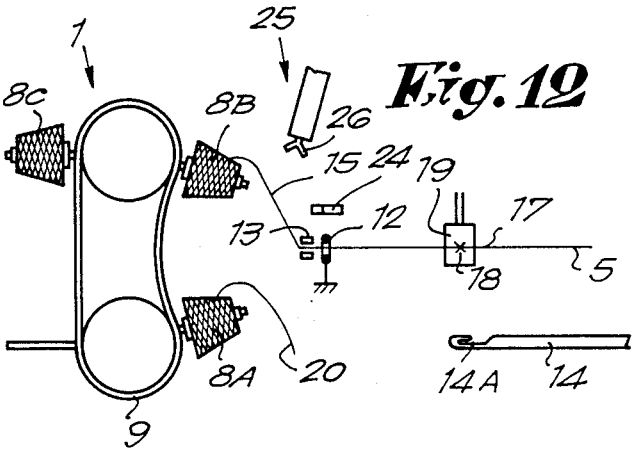

The embodiment shown in FIGS. 10 to 12 uses a fixed thread clip 24, in which the thread end 15 of each new package 8B is placed, and an auxiliary device 25 with a fork 26 which moves, e.g., by a pneumatic or hydraulic cylinder, so as to bring the thread end 15 of the supply package 8B into line with the thread eye 12 and the detector 13. Clearly in this case after the broken thread 5 has been repaired the package frame 1 is turned so that, as shown in FIG. 12, the supply package 8B is brought into the position shown for supply package 8A.

In another variant of the invention, the thread end 15 of the supply package 8B following the supply package in use 8A is caught by a suction nozzle 23, in exactly the same way as shown in FIGS. 5 and 6, after which when a thread break 16 is detected, the suction nozzle 23 is moved so that the thread end 15 is brought into the vicinity of the thread end 12 and/or the detector 13. The position obtained in this way is shown in FIG. 13. Then, as shown in FIG. 14 the thread from the supply package 8B is drawn through the thread eye 12 by means of the threading device 14.

Figure 16:
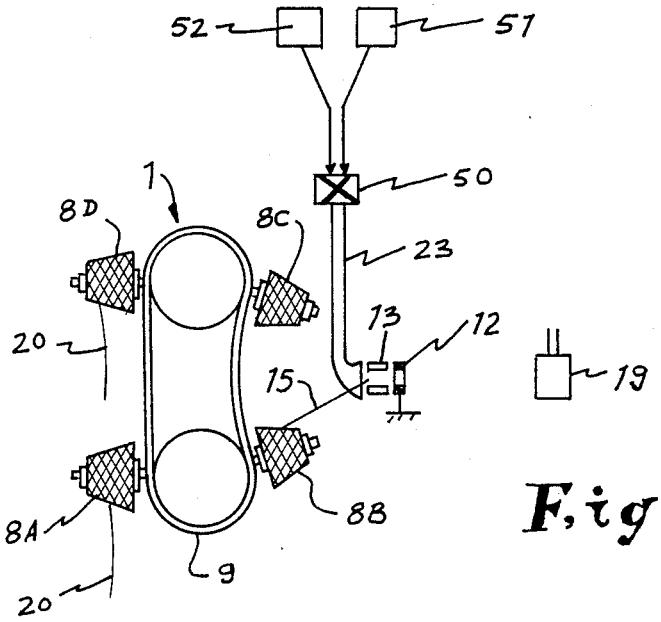

In another variant, not shown in the figures, the suction nozzle 23 is presented to the thread eye 12, whereupon the suction is cut off and compressed air supplied, so that the thread end 15 is blown through the thread eye 12. Then either the threading device 14 brings the thread end 15 to the device 19, or thread end 15 is blown directly into the vicinity of the device 19. This can be accomplished, as shown in FIG. 16, by providing a valve system 50 which can be switched into at least two positions, respectively connecting the nozzle 23 with a suction source 51 or with compressed air supplying means 52.

In yet another variant not shown in the figures, instead of the fork 26 shown in FIG. 10 a suction nozzle is used, e.g. suction nozzle 23, where the auxiliary device 25 with suction nozzle 23 can be moved as in the embodiments shown in FIGS. 5 and 13, i.e. in order to bring the thread to a particular point P, after which when a thread break occurs the bar with the suction nozzle 23 mounted on it extends until it come in front of the detector 13 and the thread eye 12, whereupon the thread can be drawn through.

If the weft section 17 is no longer located at the point at which it is to he connected to the thread end 15, it can be fetched by means of e.g. the method described in Belgian patent application No. 8700566 made by the present applicant.

The present invention is in no way limited to the embodiments described by way of example .and shown in the figures; on the contrary, such a method according to the invention can be implemented in all sorts of variants while still remaining within the scope of the invention.

I claim:

1. A method for repairing breaks in a weft thread on a weaving machine, said machine including a weft accumulator for accumulating weft threads prior to insertion into a shed, and thread supply packages for supplying weft threads to the accumulator, and wherein, when a thread break occurs, a section of the broken weft thread remains connected to the accumulator, comprising the steps of:

(a) when a thread supply package becomes emptied during the supply of weft threads to the accumulator, replacing the empty thread supply package by another thread supply package which then continues to supply thread to the accumulator;

(b) holding an end of a thread of at least said another thread supply package by means of a thread clip;

(c) monitoring a thread being supplied to the accumulator for breaks between the thread supply package and the accumulator; and (d) gripping the thread end of said another thread supply package upon detection of a thread break and joining said thread end to the broken weft section which is connected to the accumulator.

2. A method as claimed in claim 1, wherein said weaving machine includes a package frame with a conveyor belt and a threading device, and said method further comprises the steps of holding an end of a thread of each of said supply packages and carrying out the step of gripping by means of the threading device.

3. A method as claimed in claim 2 further comprising the steps of, when a break occurs in the weft thread, finding said thread end by means of a suction nozzle and bringing the thread end into said thread clip.

4. A method as claimed in claim 1 wherein said weaving machine includes a package frame with a conveyor belt and wherein said thread end is held by a pneumatic thread clip, and further comprising the steps of moving said thread end by means of said pneumatic thread clip to a predetermined point, holding said thread end at the predetermined point and, when a thread break is detected, moving the conveyor belt to present said thread end in front of a thread eye and a detector through which the weft thread is normally threaded.

5. A method as claimed in claim 1 wherein said weaving machine includes a package frame, and said method further comprises the steps of using an axuiliary device to push said thread end into line with a thread eye and a detector when a thread break is detected, the thread eye and said detector being mounted between the package frame and the accumulator, and subsequently drawing the thread end through the thread eye and the detector by means of a threading device before joining said thread end to the remaining broken weft section.

6. A method as claimed in claim 1 wherein said thread clip is a suction nozzle, and further comprising the steps of catching said thread end and holding it in the suction nozzle, and, when a thread break occurs, moving the suction nozzle so as to present the thread end of said another supply package in the vicinity of a thread eye through which the thread is normally led.

7. A method as claimed in claim 6, wherein the step of gripping said thread end is carried out by means of a threading device, and further comprising the step of drawing it through the thread eye in order for it to be joined to said weft section which is connected to the accumulator.

8. A method as claimed in claim 6, further comprising the steps of presenting the section nozzle in front of the thread eye, and subsequently switching off the suction and supplying compressed air so that the thread end is blown at least through the thread eye.

9. An apparatus for repairing breaks in a weft thread on a weaving machine, said machine including a weft accumulator having means for accumulating weft threads prior to insertion into a shed, and yarn supply packages having means for supplying weft threads to the accumulator, a section of broken weft thread remaining connected to the accumulator after a break in the weft thread, comprising:

means for continually presenting yarn supply packages in order to supply weft threads to the accumulator such that, when a first package becomes empty during the supply of weft threads to the accumulator, said continuous presentation means replaces said first package with a second package;

thread holding means for holding an end of a thread of at least said second package;

monitor means for monitoring the weft threads for breaks between said first package and the accumulator; and means for gripping said thread end upon detection of a thread break by said monitor means and for joining said thread end to the broken weft section which is connected to the accumulator.

10. An apparatus as claimed in claim 9 wherein said means for continually presenting yarn supply packages comprises a package frame with a conveyor belt and said holding means includes thread clips having means for holding the thread end of each supply package in a thread clip mounted on the conveyor belt, and wherein said means for gripping said thread end is a threading device.

11. An apparatus as claimed in claim 10 further comprising a suction nozzle and means for causing the suction nozzle to find the thread end on the corresponding supply package when a break occurs in the weft thread and bringing it back into said thread clip.

12. An apparatus as claimed in claim 9 wherein said means for continually presenting supply packages comprises a package frame including a conveyor belt along which supply packages are placed, and said holding means comprises a pneumatic thread clip including means for catching the thread end of each supply package following the supply package in use and bring it to a predetermined position such that when a thread break is detected, the conveyor belt of the package frame is moved and the thread end is presented in front of the thread eye and the detector through which the weft thread is normally threaded in response to movement of the conveyor belt.

13. An apparatus as claimed in claim 9 further comprising an auxiliary device arranged to push the thread end of the new supply package into line with a thread eye and the detector when a thread break is detected, said thread eye and detector being mounted between the package frame and the accumulator, and wherein said gripping means includes means for drawing the thread end through said thread eye and said detector by means of a threading device, and further comprising means for joining said thread end to the remaining broken weft section.

14. An apparatus as claimed in claim 9 further comprising a suction nozzle which includes means for catching and holding the thread end of the supply package following the supply package in use, and means for, when a thread break occurs, moving the suction nozzle so as to present the thread end of the new supply package in the vicinity of a thread eye through which the thread is normally led.

15. An apparatus as claimed in claim 14, wherein said threading device includes means for gripping said thread end and drawing it through the thread eye in order for it to be joined to said weft section which is connected to the accumulator.

16. An apparatus as claimed in claim 14, further comprising means for presenting the suction nozzle in front of the thread eye, and for thereafter switching off the suction and supplying compressed air so that the thread end is blown at least through the thread eye.

* * * * *